US005209394A

United States Patent [19]

Griffiths et al.

[11] Patent Number: 5,209,394

[45] Date of Patent: May 11, 1993

[54] CARTON FOR DETERGENT

[75] Inventors: Jeannine D. Griffiths, Tannersville, Pa.; Edward J. Giblin, Finksburg, Md.; James G. Covington, East Windsor, N.J.

[73] Assignee: Lever Brothers Company, N.Y.

[21] Appl. No.: 806,851

[22] Filed: Dec. 9, 1991

Related U.S. Application Data

[63] Continuation of Ser. No. 459,023, Dec. 29, 1989, abandoned.

[51] Int. Cl.[5] ..... B65D 5/46; B65D 5/54

[52] U.S. Cl. ..... 229/225; 220/416; 229/117.22; 229/117.23; 229/117.26; 229/917

[58] Field of Search ..... 229/117.19, 117.22, 229/117.23, 117.24, 117.25, 117.26, 912, 915, 917, DIG. 6, DIG. 11, DIG. 4, 225; 220/94 R, 415, 416; 383/14

[56] References Cited

U.S. PATENT DOCUMENTS

| | | | |
|---|---|---|---|
| 1,288,132 | 12/1918 | Nagle | 229/DIG. 4 |
| 2,085,062 | 6/1937 | Allen . | |
| 2,320,289 | 5/1943 | Marx . | |
| 2,348,377 | 5/1944 | Goodyear | 206/611 |
| 2,367,476 | 1/1945 | Tyrseck | 206/624 |
| 2,396,150 | 3/1946 | Bonville . | |
| 2,473,055 | 6/1949 | Guyer . | |
| 2,527,701 | 10/1950 | Buttery | 229/DIG. 4 |
| 2,625,315 | 1/1953 | Fehrenkamp | 229/DIG. 4 |
| 2,672,273 | 3/1954 | Smith | 220/416 |
| 2,706,076 | 4/1955 | Guyer . | |
| 2,758,780 | 8/1956 | Imbs | 220/416 |
| 2,822,118 | 2/1958 | Will | 206/624 |
| 2,836,342 | 5/1958 | Ringler . | |
| 2,836,343 | 5/1958 | Will | 206/624 |
| 2,874,524 | 2/1959 | Ringler . | |
| 2,922,564 | 1/1960 | Van Rosen . | |
| 2,922,565 | 1/1960 | Roderick et al. . | |
| 2,967,656 | 1/1961 | Vergobbi | 229/117.22 |
| 2,988,262 | 6/1961 | Guyer . | |
| 2,998,910 | 9/1961 | Gillam . | |
| 3,117,709 | 1/1964 | Fuchs . | |
| 3,189,251 | 6/1965 | McFarland . | |
| 3,207,416 | 9/1965 | Koltz et al. . | |
| 3,337,114 | 8/1967 | Lockwood | 229/3.1 |
| 3,347,446 | 10/1967 | Guyer et al. | 220/416 |
| 3,438,563 | 4/1969 | Collura et al. . | |
| 5,058,748 | 10/1991 | Giblin et al. . | |

FOREIGN PATENT DOCUMENTS

| | | | |
|---|---|---|---|
| 682681 | 3/1964 | Canada | 229/117.23 |
| 114771 | 8/1984 | European Pat. Off. | 229/117.22 |
| 2801729 | 7/1979 | Fed. Rep. of Germany | 229/117.23 |
| 3140390 | 4/1983 | Fed. Rep. of Germany | 229/117.24 |
| 2483885 | 12/1981 | France | 229/117.23 |
| 2484958 | 12/1981 | France | 229/117.23 |

*Primary Examiner*—Gary E. Elkins
*Attorney, Agent, or Firm*—Gerard J. McGowan, Jr.

[57] ABSTRACT

A carton having two broad sides, two narrow sides and a tear tape spaced from the top and functionally extending through part or all of three of the sides but not extending completely through the fourth side. The fourth side is one of the narrow sides and functions as a hinge. When the tear tape is removed, the upper portions of three panels are separated from the lower aspects. The upper portions of the panels together with the top of the carton from a cover which pivots along the hinge formed by the fourth side. The carton is readily opened by means of the tear tape, yet product can be poured by grasping the carton's narrow end in the fashion of a traditional detergent carton. The carton may include a liner which extends to virtually the full height of the carton.

28 Claims, 8 Drawing Sheets

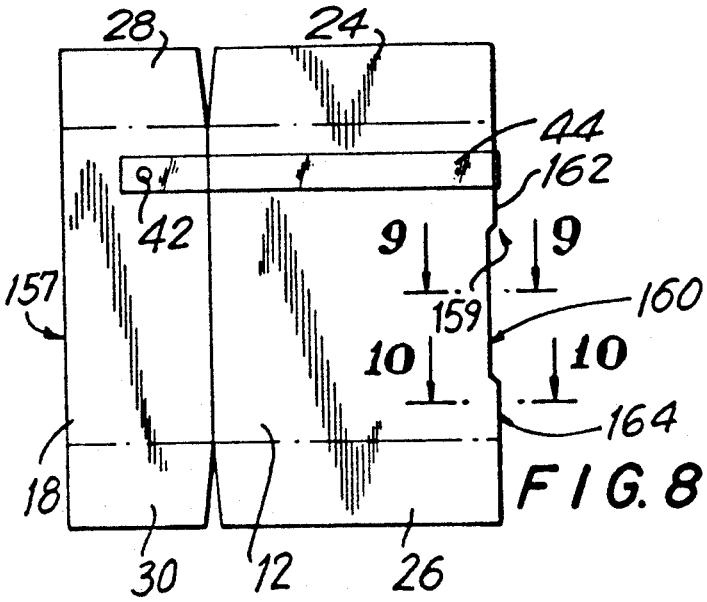
FIG. 8
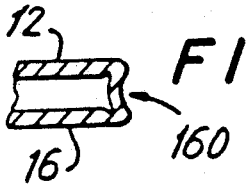
FIG. 9
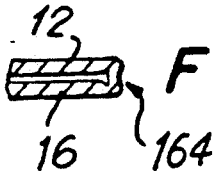
FIG. 10
FIG. 14
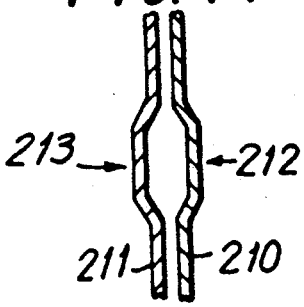
FIG. 15
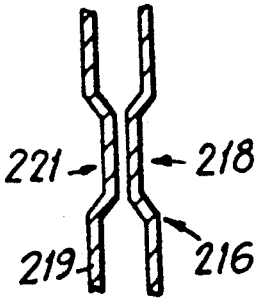

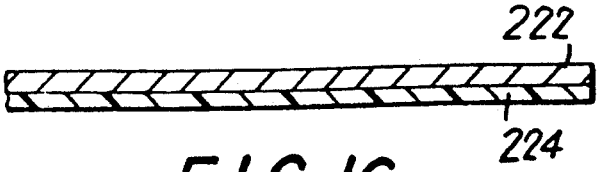
FIG. 16
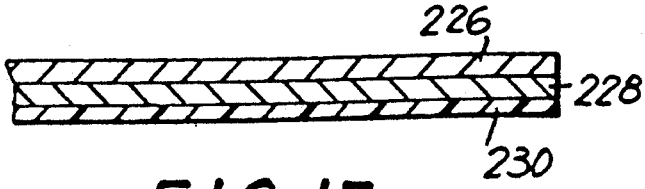
FIG. 17
FIG. 18
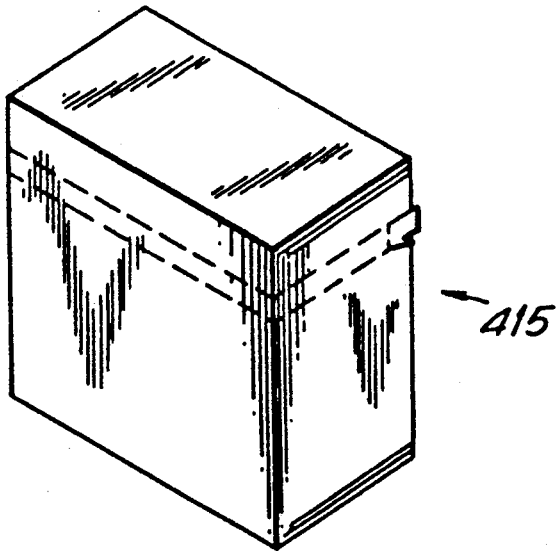

CARTON FOR DETERGENT

This is a continuation of U.S. patent application Ser. No. 07/459,023, filed Dec. 29, 1989, now abandoned.

BACKGROUND OF THE INVENTION

Typically cartons for powdered laundry detergents include perforations for forming an opening in the carton. The consumer is expected to punch in the area of the carton wall defined by the perforations to create the opening through which the product can be poured. This procedure is frequently a difficult one since the carton walls are often not readily punctured by the consumer, notwithstanding the perforations. Moreover, the force needed to create the opening may cause some of the powdery product to escape undesirably from the carton. Another problem is that once the opening is created, it is difficult or impossible to close. As a result, subsequent inadvertent release of the product is not unusual.

A previous carton has included a tear tape spaced several inches from the top and functionally extending around at least three complete sides of the carton. The fourth side, which is left largely intact, is the broad rear panel, which serves as a hinge for the cover created by the tear tape. No liner is used in this previous carton.

Another prior carton has included a tear tape spaced from the top and functionally extending completely through all four sides of the carton, so that the cover created by the tape can be completely removed. This previous carton includes a four-sided liner, each wall of which corresponds closely in dimension to one of the four panels of the carton. The liner serves to retain the cover on the carton after the tear tape has been removed. However, the removable cover may be misplaced. Moreover, use of a removable cover tends to maximize the exposure of the product to the air and moisture and increases the potential for loss of volatile components.

While the above-described detergent cartons are acceptable and desirable for certain products, there is a need for an improved carton without a removable lid in the traditional detergent carton configuration, wherein the consumer can pour the product by grasping the narrow end of the container and tilting the opposite end forward

SUMMARY OF THE INVENTION

The present invention comprises a carton having two broad sides and two narrow sides and including a tear tape spaced from the top functionally extending through part or all of three of the sides but not extending completely through the fourth side because it is cut. The fourth side is one of the narrow sides and functions as a hinge. When the tear tape is removed, the upper portions of three panels are separated from the lower aspects. The upper portions of the panels together with the top of the carton form a cover which pivots along the hinge formed by the fourth side. The carton is readily opened by means of the tear tape, yet product can be poured by grasping the carton's narrow end in the fashion of a traditional detergent carton.

In a particularly advantageous embodiment, the carton includes a liner which extends to virtually the full height of the carton. When the cover is formed by the upper aspects of the carton upon removal of the tear tape, it can rest on the liner. The liner also tends to impede leakage of the product when the cover is closed.

For a more complete understanding of the above and other features and advantages of the invention, reference should be made to the following detailed description of preferred embodiments and to the accompanying drawings.

BRIEF DESCRIPTION OF THE DRAWINGS

FIG. 8 is a plan view of a flat tubular carton having thickened score lines for balancing.

FIG. 9 is a cross section along the lines 9—9 of FIG. 8.

FIG. 10 is a cross section along the lines 10—10 of FIG. 8.

FIG. 14 is a cross section through a carton blank and liner having embossments.

FIG. 15 is a cross section through a carton blank and liner having opposing debossments.

FIG. 16 is a cross section of a carton blank which is inside-film laminated.

FIG. 17 is a cross section of a carton blank associated with a liner which is inside-film laminated.

FIG. 18 is a perspective view of a carton for concentrated detergents according to the invention which does not have a handle.

DETAILED DESCRIPTION OF THE INVENTION

While the present invention is most particularly illustrated in FIGS. 21 and 22, it is best understood as a specific embodiment of Giblin et al. U.S. patent Ser. No. 07/459,015 entitled "Carton for Concentrated Detergent" filed simultaneously herewith. Therefore, the invention is described herein in that context.

Figure 1:
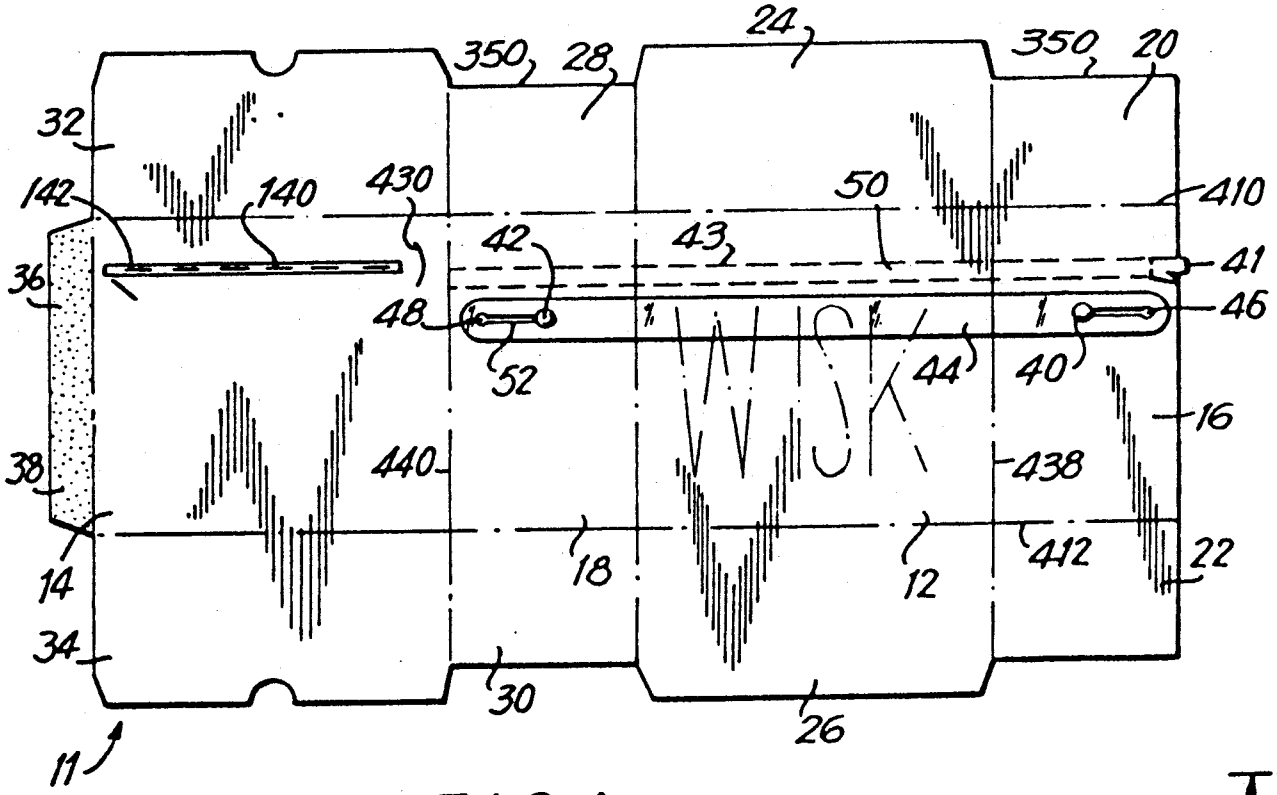
FIG. 1 is a top plan view of the carton blank used for preparing a carton with a handle.

Referring to FIG. 1, the carton blank 11 comprises front panel 12, first and second side panels 16 and 18, respectively, and rear panel 14. Upper and lower minor flaps 20 and 22, respectively extend from side panel 16. Extending from the top and bottom of front panel 12 are upper and lower outside major flaps 24 and 26, respectively. Similarly, upper and lower minor flaps 28 and 30 extend from the top and bottom of side panel 18, whereas upper and lower inside major flaps 32 and 34 extend respectively from the top and bottom of rear panel 14. The minor panels are separated from the upper and lower flaps by score lines 410 and 412, respectively.

Preferably, the minor flaps adjacent the upper aspects of the side panels are dimensioned such that when they are folded inward during erection of the carton, their medial edges 350 are fairly close to each other. They may meet or almost meet (See FIG. 7) or they may be somewhat separated (See e.g. FIG. 6). Edges 350 may, for instance, be approximately one inch apart. Preferably, the combined area of the upper minor flaps is at least 75%, especially, 85%, and particularly 90 to 95% of the area of the larger of the inside or outside major flap This provides an added barrier against entry of moisture and other undesirable elements and against loss of product components such as perfumes, particularly when a strip of adhesive is applied parallel to and near medial edge 350 This will also prevent powder from collecting under the minor flaps and then flying out when the cover is opened.

Figure 6:
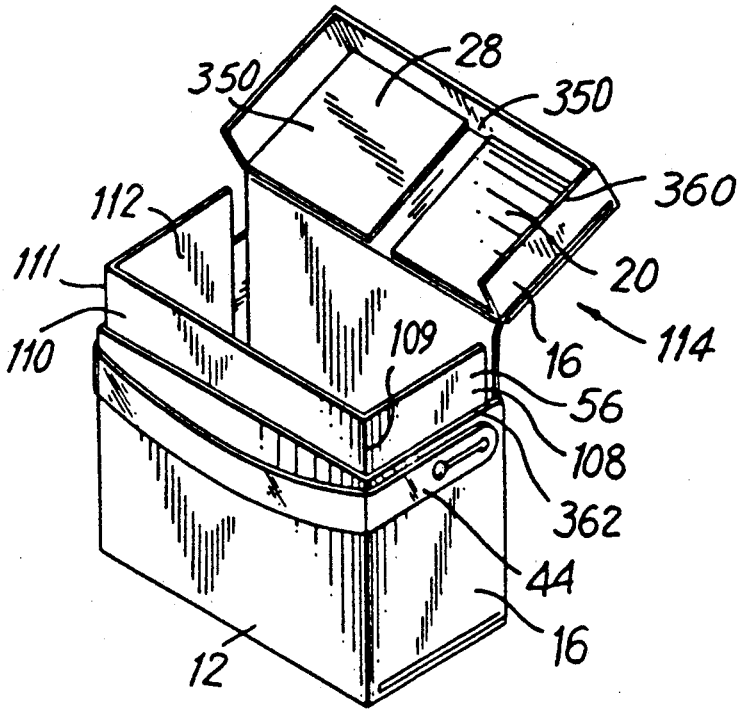
FIG. 6 is a perspective view of the carton of FIG. 3 after opening.

In the case of the carton of FIGS. 1 and 6, the edges of the minor flaps do not meet and the combined area of the minor flaps is approximately 80% of the outside major flap. For the carton of FIGS. 7, combined lengths of minor flaps 20 and 28 in the direction perpendicular to the length of the carton blank is equal or approximately equal to the length of major flap 24. In the same way, the lower minor flaps may also be dimensioned so that their edges meet or almost meet when folded inwardly.

Glue flap 36 extends off of rear panel 14. Adhesive means are applied to the glue flap at 38 during erection. When the carton is in the flattened tubular form shown in FIG. 2, adhesive means 38 adheres the front surface of glue flap 36 to the side panel.

Figure 20:
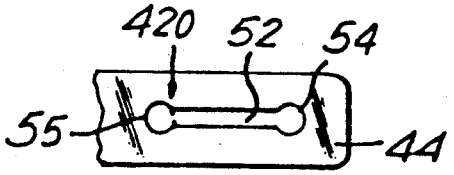
FIG. 20 is a plan view with portions cut away of a preferred handle.

Attached to side panels 16 and 18 by rivets 40 and 42 is a handle 44. The handle, which takes the form of a strap, is narrow in width and long in length. The handle is preferably flexible and clear, like handle 44, so that any printing on front panel 12 can be seen through the handle. Preferably, the handle slightly magnifies any printing on the front panel. Handle 44 includes dumbbell-shaped apertures 46 and 48, respectively at its ends, which accommodate rivets 40 and 42. Each dumbbell-shaped aperture includes a straight portion 52 connecting two semicircular end portions, a distal portion 54 and a proximal portion 55 (See FIGS. 4 and 20). Proximal portion 55 preferably has top and bottom detents 420 facing inwardly, which help retain the handle around the shank when the handle is in the shipping position.

Figure 2:
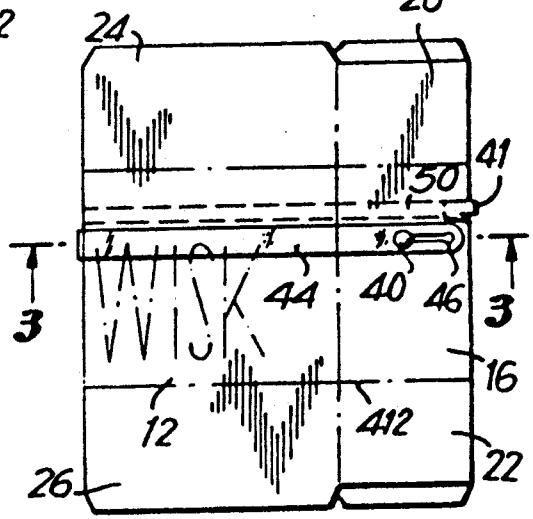
FIG. 2 is a top plan view of a flat tubular carton with a handle.

As best seen in FIGS. 1 and 2, a tear tape 50 is provided for opening of the carton. The tear tape comprises two generally parallel lines of perforations 43 in the paperboard and finger tab 41 for grasping by the consumer. Preferably, the finger tab extends beyond the edge of the carton for easier access. Instead of perforations, other separation means such as cut scores may be employed. The cut scores extend partially through the paperboard. The tear tape extends from first side panel 16 through front panel 12, second side panel 18 and terminates functionally on rear panel 14 by virtue of cut 430. The operation of the tear tape will be described in greater detail below. Advantageously, rivets 40 and 42 are located below the level of tear tape 50 so that the handle need not move when the cover is opened and closed.

Figure 3:
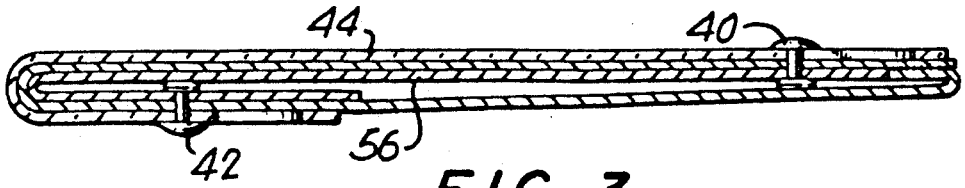
FIG. 3 is a cross section along the lines 3—3 of FIG. 2.

As can be seen in FIG. 3, rivets 40 and 42 extend through handle 44, the side panel to which it is attached, and through optional inside liner 56. As discussed below, the inside liner, if present, may be of varying configurations. Three sided liners such as liner 56, and particularly four-sided liners, are preferred.

The carton of the invention is fabricated by preparing the carton blank shown in FIG. 1 and erecting the carton. The first step in the erection of the carton is adhering the front surface of glue flap 36 to the rear surface of side panel 16 to obtain a flat, tubular partially erected structure such as that shown in FIGS. 2 and 3. While the carton of FIG. 2 is folded along the score between panels 12 and 18 and at the junction between panels 14 and 16, it may well be desirable to fold it along scores 438 and 440. After the flat tube is formed, the carton is squared, and the minor flaps and subsequently the inside and outside major flaps respectively, are folded inwardly and adhered to each other.

As can be seen from FIGS. I, 2 and 4, handle 44 is fastened to extend across the front of front panel 12. It is desirable for ease of manufacture that the handle can be affixed to the carton prior to erection It can be seen particularly from FIG. 1, that were it attempted to fasten the handle across rear panel 14 instead of front panel 12, it would not be possible to do so until the carton is at least partially erected by gluing glue flap 36 to side panel 16. Another alternative would be to let panel 12 constitute the rear rather than the front panel of the carton. However, since the right rear corner 58 of the erected carton at which the glue flap is bound to the side panel tends to be less attractive than the other corners of the package, it could detract from the appearance of the package to change the location of the corner to a front corner to permit the handle to be fastened across the rear of the container.

Figure 4:
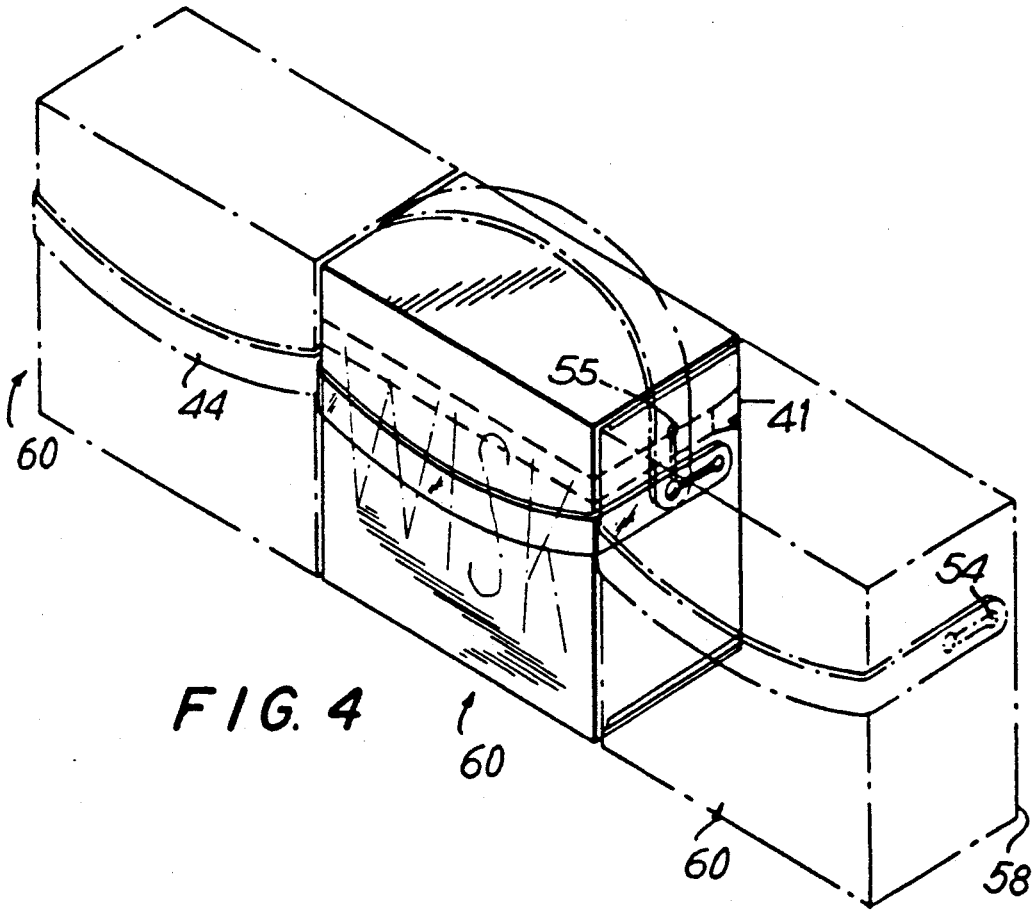
FIG. 4 is a top perspective view of three cartons having handles.

When the handle 44 is clear, it is possible to fasten the handle across the front panel of the carton without preventing the consumer from observing the printing on the front panel. The erected cartons 60 may be displayed side-by-side, as illustrated in FIG. 4. Handle 44 extends across the face of front panel 12 without obscuring information on the panel which may attract the consumer to the product or which may be important to the consumer in deciding whether to purchase the product. There is no need to perform the extra step of moving the handle from its original position across the face of the front panel to the top or the rear of the carton; moreover, the additional machinery and/or personnel which would be required to change the position of the handle after erection of the carton are unnecessary if the clear handle is used. Since the handle extends across the front of the carton it does not interfere with vertical stacking of the cartons, if desired.

When the consumer takes the package off the shelf, he/she may pull the handle forward and upward to change its position so that it extends across the top of the carton. When a handle extending across the front of the carton as shown in FIG. 4 is pulled forward, the rivets on either side of the carton leave proximal semicircular portions 55 of apertures 46, 48 and initially enter straight and narrow portions 52. Then, they enter the distal semicircular portions 54 at the other end of the aperture so that the handle is free to pivot therewithin. When the rivets are in the distal semicircular portions, the effective length of the handle is increased. This permits the handle to be extended over the top of the carton. Moreover, when extended over the top of the carton the handle with enhanced effective length has sufficient slack for convenient carrying. Thus, while the distal aspects of the semicircular apertures permit the handle to be slack for carrying, the proximal semicircular aspects of the apertures permit the handle to be stretched reasonably taut for handling during carton manufacture and shipping as seen respectively in FIGS. 1 and 4. As indicated above, detents 420 may be used, particularly in proximal aspects 55, to keep the handle in position.

Figure 5:
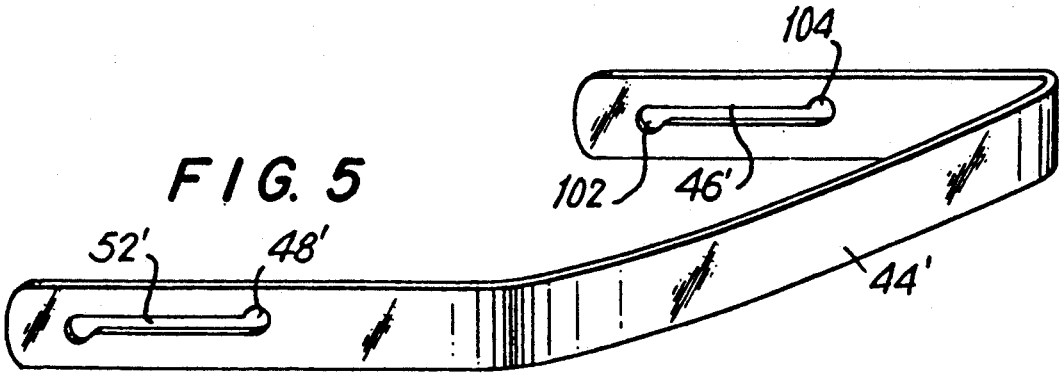
FIG. 5 is a perspective view of an alternative handle.

In an alternate embodiment seen in FIG. 5, the handle 44' includes S-shaped apertures 46' and 48' each of which includes a straight, narrow portion 52' and rounded, roughly semicircular aspects at each end. Consistent with the S-shape of the aperture, one of the semicircular ends, 102, faces downward whereas the second semicircular end, 104, faces upward. Operation of the carton having the handle with S-shaped apertures is the same as that for the carton having a handle with dumbbell-shaped apertures. The tangential placement of the semicircular ends within the apertures follows the natural pulling motion required to extend the handle from shipping to carrying position Where the length of the erected carton (i.e., the length of the front panel) is B, the width of the carton is A, and the diameter of the rivet shank is C, the following are preferred approximate dimensions for the handle and rivets:

length of handle: $2A+B$ distance between center points of the two distal semicircular ends:

minimum $1.33A+B$; maximum: $2A+B-0.75$ distance between center points of the two proximal semicircular ends: $A+B+\frac{1}{8}$ width of straight and narrow handle portion: 0.9C distance from top of erected carton to midpoint of rivet: 0.4A distance from end of side panel to center of rivet: 0.5A The carton of the invention may be made of any of the materials typically used for carton manufacture, such as paperboard or plastic. In accordance with another aspect of the invention, if it is desired, the carton blank may be made of, or adhered to, a barrier material. Barrier materials are useful particularly to inhibit the entry of moisture and oxygen into the carton and to minimize the escape of perfume and any other volatile ingredients out of the carton. The carton blank may comprise outside- or inside-film laminated paperboard. The paperboard may be laminated with, e.g., a film of two-sided acrylic coated oriented polypropylene, e.g. "420HS" available from the Mobil Oil Corporation, or polyethylene. Or, the carton blank may comprise a barrier board such as "MVTR Board," or "Super MVTR Board," available from Jefferson Smurfit/Container Corporation of America. "MVTR Board" includes a mill-applied chemical barrier treatment as well as barriers applied in the printing operation. "Super MVTR Board" is a clay coated, chemically-treated paperboard having a high gloss top coating, catalytic or lacquer. A barrier may also be created by polyethylene or other extrusion coating or via printed coatings. In FIG. 16, carton blank 222 is laminated to a barrier film 224 of polypropylene. By barrier is meant a water vapor transmission rate of greater than 0.5 grams of water per 100 square inches per 24 hours at 80° F./80% R. H., typically from 0.5 to 0.9, especially 0.7 for inside film laminated paperboard. "Super MVTR Board" has a typical MVTR of 0.8 with a useful range of 0.7 to 1.2.

The rivets of the carton of the invention are made of metal or plastic, preferably metal. The flexible clear or opaque handle is made, preferably by extrusion, of ethylene vinyl acetate (typically 93% low density polyethylene and 7% vinyl acetate), styrene-ethylene/butylene styrene (e.g., Shell's Kraton, a high clarity thermoplastic elastomer), polyvinyl chloride or other plastic or other materials suitable for providing the durability required of a handle. In the case of the clear handle, the material should be clear enough that writing on the carton is not obscured.

In order to ensure that the handle not obscure writing on the carton, it is preferred that the light transmission, as measured for a 1.00 mm thick handle, range from 50% to 100%, preferably 60% to 99%, more preferably 75% to 99%, and especially from 85% to 95%. Typical light transmission values for the materials mentioned above for a 1.00 mm thick handle are 84% for polyvinyl chloride, 91% for ethylene vinyl acetate and 99% for Shell's Kraton.

In an advantageous embodiment, the handle of the invention is made of a material which magnifies the printing on the carton. This can be achieved by selecting a curved surface for the outer face of the handle. The flat inner face helps keep the handle snugger to the carton. The handle may also be made with high clarity pigmented material. A pigmented handle may be used to alter the appearance of that portion of the front panel which is viewed through the handle As indicated above, the carton of the invention may be provided with tear tape 50, illustrated in FIGS. 1 and 2, for easy opening. Pulling on the tear tape separates the portions of the carton above the tear tape from those below the tear tape, thereby opening the carton, as can be seen in, e.g., FIG. 6. If desired, a small plastic filament or other cord may be adhered to the inside of the tear tape intermediate the cut scores or perforated lines to enhance tearability. The filament may be impregnated with hot melt for hot sealing. The tear tape preferably extends functionally across substantial portions of only three panels of the carton, side panel 16, front panel 12 and side panel 18. Since the tear tape does not extend across substantial portions of rear panel 14, the upper portions of the erected carton, which serve as a cover, remain associated with the lower portions at the rear panel, which serves as a hinge. Thus, once the tear tape is pulled thereby separating upper and lower aspects of the carton on three sides, the upper aspects can be left in the closed position or can be lifted into the open position remaining associated with the lower aspects only at the rear panel. In that open position, the consumer has access to the product and may lower the upper aspects of the carton back into closed position when desired.

In accordance with the invention, the role of the rear panel as a hinge is facilitated by the addition of hinge means thereto. As seen in FIG. 1, rear panel 14 includes two hinge means, perforations 140 and score line 142, both of which extend along the same line as the uppermost of the tear tape cut score or perforations 43. The illustrated hinge means acts as a deadfold hinge in that it keeps the open cover in the open position until the consumer closes the cover.

As mentioned above, the carton may be provided with liners of various configurations. Three sided liner 56 can be best seen in FIG. 6. Liner 56 comprises a first side panel 108, a front panel 110 separated from side panel 108 by score line 109, and a second side panel 112 separated from panel 110 by score line 111. The liner serves to reinforce the structure of the carton and enhance its barrier properties. It can be seen in FIG. 6 that liner 56 provides a wall upon which cover 114 of the carton can rest when it is in the closed position. Liner 56 minimizes the exposure of the contents which would otherwise result from the gap between the bottom edge 360 of the cover and the top edge 362 of the panels which result from the removal of the tear tape. The dimensions of the panels of the liner are preferably only slightly smaller than those of the corresponding panels of the carton (prior to opening the carton), so that the liner can fit snugly within the carton with the liner panels adjacent the corresponding carton panels. In order to close the container more effectively in one embodiment, the liner may be somewhat larger than the height of the carton and be scored on its top edge so that when the cover is closed the liner folds for more intimate contact with the cover. This is particularly beneficial for liners having barrier properties.

The liners according to the invention are preferably clay coated and the top portion is printed, at least on the side facing the consumer when the carton is open, so as not to detract from the appearance of the package. The printing may, for instance, match that of the outside of the carton.

The liners for the cartons of the invention may be fabricated of paperboard. Alternatively, the liners may be made of a plastic material such as polypropylene. Plastic liners may be thermoformed.

Figure 7:
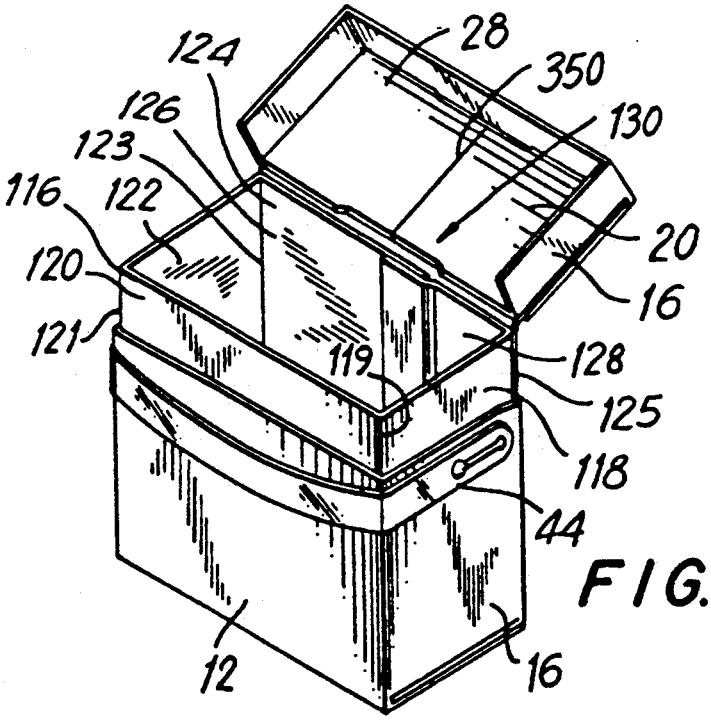
FIG. 7 is a perspective view of an open carton having a four-sided liner.

Particularly preferred are four-sided liners having sides adjacent each of the sides of the carton, as seen in FIG. 7. Four sided liner 116 includes a first side panel 118, a front panel 120 separated from panel 118 by score line 119, a second side panel 122 separated from panel 120 by score line 121, and a rear wall 124 separated from panel 122 by score line 123 and from side panel 118 by score line 125. Rear wall 124 is preferably formed by the overlap of panels 126 and 128 as at 130 in FIG. 7. With this arrangement, the extra thickness at overlap 130 helps balance the carton when it is in the flat, tubular form shown in FIG. 2. Absent balancing means, when partially erected cartons in that form are stacked, the rivets and the handle tend to create a localized increase in thickness which results in an imbalance which will cause the stack to topple over. Advantageously, the overlap where the liner is adhered to itself to create a closed rectangle is situated so as to relieve the imbalance created by the rivets and the handle. It is preferred that the overlap be situated in the middle third of the rear wall, particularly to the right of the midline of the rear wall, as illustrated in FIG. 7. It is especially preferred that the overlap be located between 50 and 85% of the length of the rear panel, especially between 60 and 75% of its length.

As indicated above, the carton blank may be made of a barrier material or provided with a barrier layer. As an additional or alternate feature, the liner may be constituted of or provided with a barrier material. Thus, the liner may be provided with an outside or inside film lamination of a film such as two-sided acrylic-coated oriented polypropylene (Mobil's 420 HS) or polyethylene. FIG. 17 illustrates a paperboard carton blank 226 to which a liner 228 has been riveted (rivets not shown). Liner 228 has a barrier layer 230 adhered thereto. Alternatively, the liner may be comprised of "Super MVTR Board" or another board having barrier properties. The barrier may also be a polyethylene or other extrusion coating or a printed coating. It will be appreciated that either the carton blank or the liner or both may be comprised of or have adhered thereto a barrier material.

An additional solution to the balancing problem discussed above is illustrated in FIGS. 8 through 10, which illustrate a balancing means integral with the carton blank. In FIG. 8, portion 160 of score line 159 is thickened relative to the rest of the line, namely, portions 162 and 164. If the fold line is a 3-point rule score, then the thickened portion could be a 6-point rule score. The extra thick score tends to balance, at least partially, the rivets and the handle when the flattened, tubular cartons are stacked, whereas the regular score lines above and below the thickened score line contribute to sharper folding of the carton. Side 157 is thickened by virtue of the glue flap. When the tube is formed by folding along the two scores other than score 159, then it will generally be desirable to thicken both scores.

Figure 13:
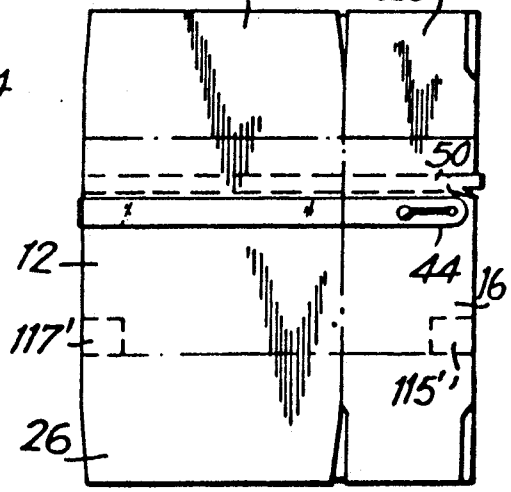
FIG. 13 is top plan view of a flat tubular carton having winged spacers.
Figure 11:
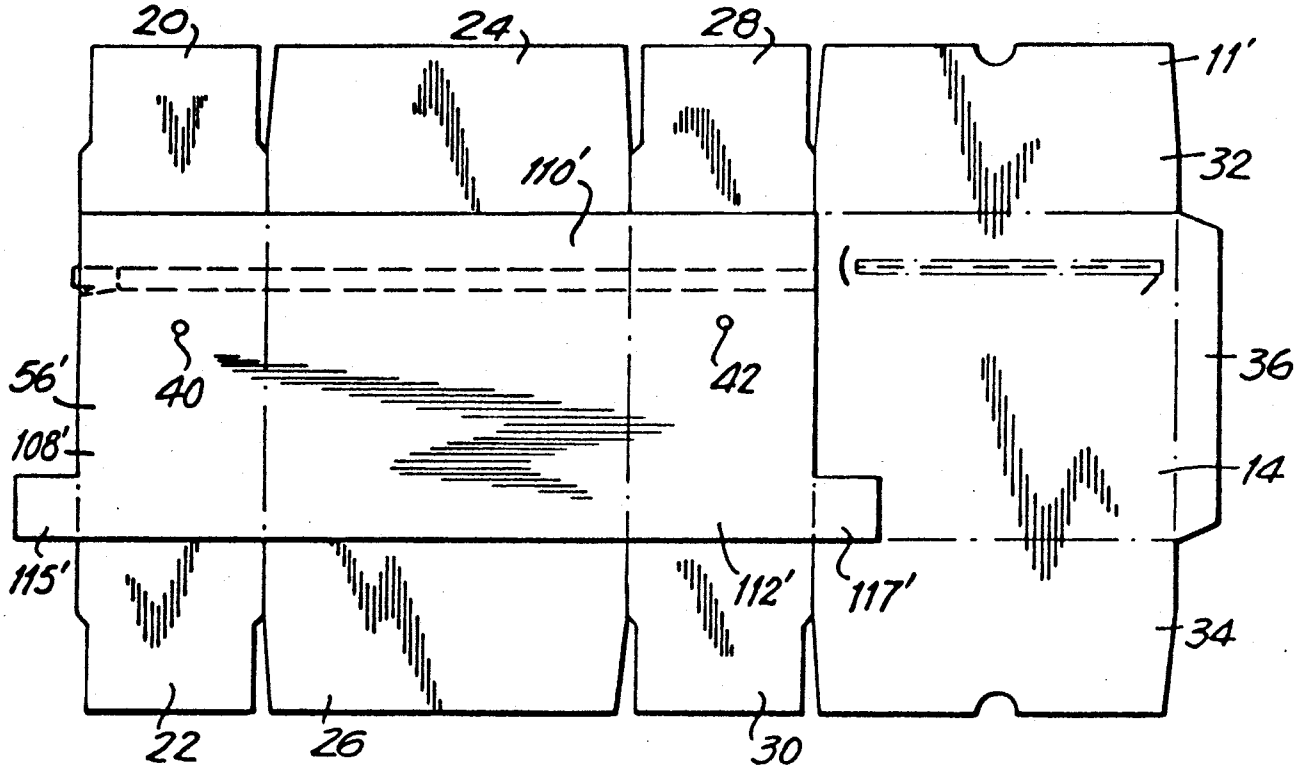
FIG. 11 is a plan view of the inside of a carton blank having a three-sided, winged liner riveted thereto
Figure 12:
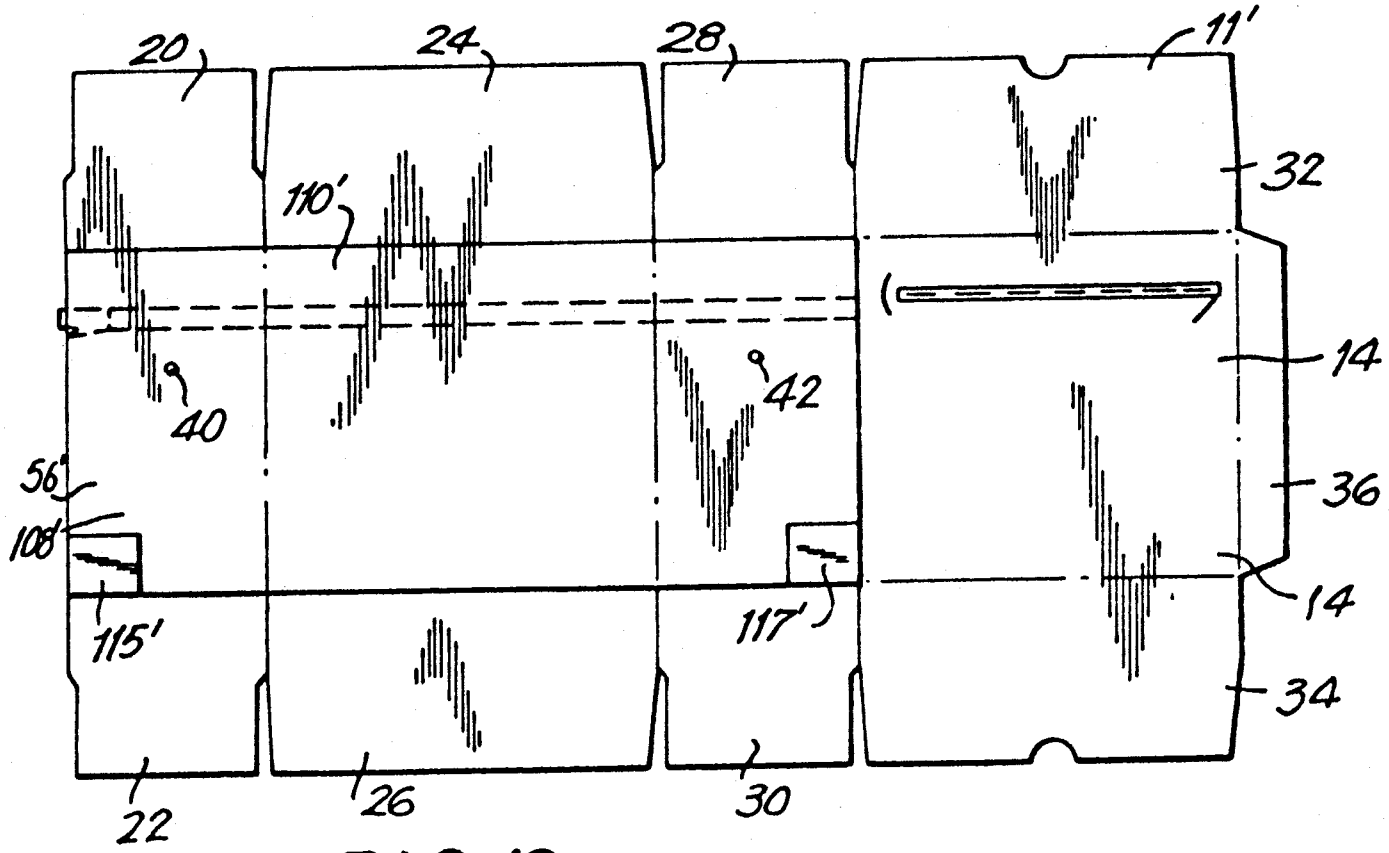
FIG. 12 is a plan view similar to FIG. 11, except that the spacing wings are folded into spacing position.

Integral balancing means may be used on the liner as well as the carton blank. FIGS. 11–13 illustrate one type of balancing means integral with the liner. In FIG. 13, a three-sided liner 56' overlies and is riveted to the inside of carton blank 11'. The liner comprises side panel 108' adjacent front panel 110', which in turn is adjacent side panel 112'. Integral wings 115' and 117' extend from side panels 108' and 112' respectively. In operation, the wings are folded back over the respective side panels from which they depend, as seen in FIG. 12. Once the carton has been partially erected by adhering glue flap 36 to side panel 16 and folded into a flattened tube as seen in FIG. 13, the folded back winged spacers 115' and 117' assist in balancing the thickness of the rivets and the handle, so that the partially erected cartons can be stacked with minimal imbalance.

A further alternate form of integral spacer is an embossment of either the liner or the carton itself or both. As seen in FIG. 14, liner 210 and carton board 211 include embossments 212 and 213 which results in an effective thickening of the liner at that location. The embossment or embossments are situated in the liner and/or the carton blank in such a location that it partially or fully balances the thickness in the partially erected carton attributable to the rivets and the handle. In this way, uneven stacking of the cartons is prevented or minimized. Suitable locations for the embossments include those illustrated for the folded wings in FIG. 13.

The stackability of partially erected cartons may also be addressed by the use of debossments in the liner or the carton blank or both, particularly the carton blank. FIG. 15 illustrates a carton blank 216 upon which a debossment 218 has been imposed and a liner 219 upon which debossment 221 has been imposed. The debossment may be situated below the rivets and handle and would hereby balance their extra thicknesses. Liners fabricated from plastic materials such as polypropylene are particularly suitable where debossments are to be used since debossments can be formed more deeply onto plastic materials than paperboard.

The extra thickness provided by the previously discussed balancing solution may desirably be within the range of from 0.08 to 0.25, preferably 0.1 to 0.25 inch thickness.

It may be desired to omit the handle in certain cartons, particularly cartons of a small size. Such a carton 415 is illustrated in FIG. 18. The carton is identical to cartons heretofore illustrated and described except that it lacks the handle and rivets. The use of a handle- and rivet-free carton can be advantageous, particularly in that there is no need for the balancing means described above. However, the handle-free carton does benefit from the other features of the invention including the three and four-sided liners, the long dust flaps, the inside- or outside- film lamination of the carton board or use of barrier carton board, the alternate and/or additional use of barrier-laminated liners or barrier materials for liners and/or the hinge comprising perforated and/or scored lines as hereinbefore described with the carton including handles and rivets.

The carton of the invention is advantageously used to contain powdered detergent, preferably concentrated or superconcentrated detergents. Preferred densities for such detergents include 500 to 700 grams per liter for concentrated and, especially 700 to 1000 grams/liter for superconcentrated. Preferably a scoop is enclosed within the detergent carton to assist the consumer in dispensing the product.

Figure 19:
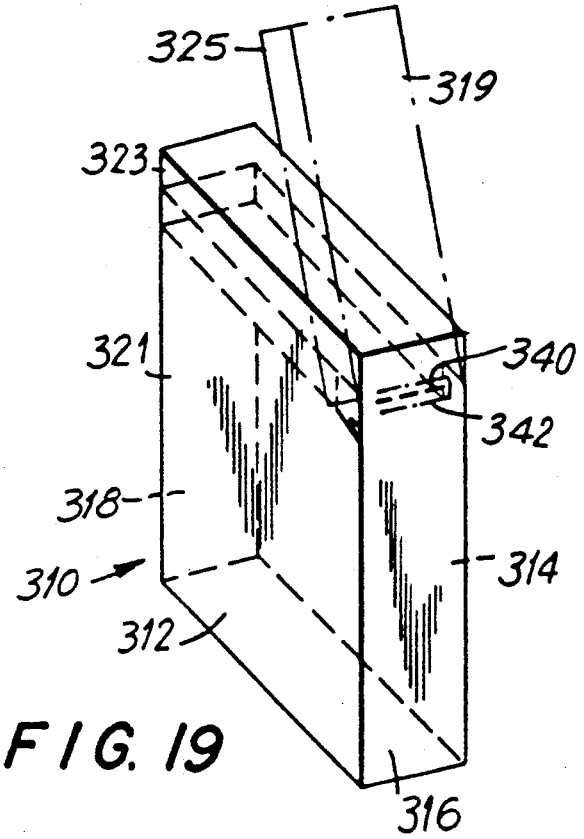
FIG. 19 is a perspective view of a carton according to the invention.

FIG. 19 illustrates an alternate embodiment of the invention. Carton 310 is constructed similarly to the cartons previously described except that the hinge is on one of the narrow panels instead of one of the broader panels. Carton 310 comprises first side panel 316, front panel 312, second side panel 318 and rear panel 314. The carton is formed by adhering a glue flap (not shown) appended to rear panel 314 to first side panel 316 and then folding inwardly and adhering together the various upper and lower major and minor flaps to produce a fully erected carton.

Carton 310 is provided with a tear tape like the one shown above for separating the cover 319 from the body 321 of the carton. The tear tape comprises a pair of perforated or cut scored, generally parallel lines in the carton board which extend at least from front panel 312 through first side panel 318 to rear panel 314. Portions of the tear tape may be present on first side panel 316, as well, although most of panel 316 is left intact to permit it to serve as a hinge. A narrow cord or plastic filament can be adhered to the tear tape intermediate the parallel cut scores or perforations to facilitate separation of the tear tape, but the tear tape filament is cut to leave most of the first side panel intact. Carton 310 includes a four-sided, full height liner. Each of the four panels of the liner is just slightly smaller than the corresponding panel of the carton so that the liner can be accommodated within the closed carton. First side panel 316 includes perforations 340 and score line 342 in the same plane as bottom edge 325 of the cover to enable first side panel 316 to function as a hinge.

As seen in FIG. 19, score line 342 is spaced from both the top and bottom closure flaps of the carton.

As in the case of previous embodiments, the liner for carton 310 may be three or four-sided and serves to enhance the closability of the carton and improve barrier features. The carton and/or the liner may be inside- or outside-film laminated to provide barrier properties; or, a barrier material such as "Super MVTR Board" may be used as the carton blank and/or the liner. The embodiment of FIG. 19 may be used in various dimensions, such as those used for standard powdered detergent cartons.

Where a three-sided liner is used, to balance the flat, tubular carton from which the carton is erected, a dual thickness working score opposite the folded three sided liner may be used. For instance, 4-point rule scoresmay be used within 1½ inches from the corners and 6- or 8-point rule scores may be used in the middle for thickening.

As mentioned earlier, the embodiment of FIG. 19 permits the consumer to dispense product from the carton more or less in the manner of a standard detergent carton by grasping a narrow edge of the carton and pouring. Yet, the carton does not include the difficult-to-use perforated opening which is often present. Nor does it employ the environmentally less desirable plastic fitments which have recently appeared in the market.

As seen in FIG. 19, the perforated line within the score line does not extend to the score lines on either side of the panel.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

What is claimed is:

1. A carton comprising a) a first side panel, b) a front panel adjacent thereto, c) a second side panel adjacent to said front panel on the side opposite said first side panel, d) a rear panel between said first and second side panels, e) said front and rear panels being broader than said side panels, f) bottom closure flaps, g) top closure flaps, h) a tear tape extending at least from said front panel across one of said side panels to said rear panel, said tear tape not fully traversing the other of said side panels so that said other side panel serves as a hinge when said tear tape is removed, a liner including at least three walls, and further comprising hinge means on said other side panel including a perforated line within a score line.

2. The carton of claim 1 wherein at least one wall of the liner is substantially the same height as the panel which it lines.

3. The carton of claim 2 wherein each wall of said liner has substantially the same dimensions as one of said panels of said carton prior to removal of the tear tape.

4. The carton of claim 1 wherein said liner comprises four walls each of which has substantially the same dimensions as one of said panels of said carton prior to removal of the tear tape.

5. The carton of claim 1 wherein said tear tape comprises two generally parallel lines of weakness in said panels.

6. The carton according to claim 1 wherein the second side panel has two sides and is defined by score lines on both sides and wherein the perforated line within the score line does not extend to either of said panel-defining score lines.

7. The carton according to claim 1 wherein said perforated line within a score line is in the same plane as the tear tape.

8. A carton comprising a) a first side panel, b) a front panel adjacent thereto, c) a second side panel adjacent to said front panel on the side opposite said first side panel, d) a rear panel between said first and second side panels, e) said front and rear panels being broader than said side panels, f) bottom closure flaps, g) top closure flaps, h) a tear tape extending completely through said front panel, one of said side panels and said rear panel, said tear tape not fully traversing the other of said side panels so that said other side panel serves as a hinge when said tear tape is removed, further comprising hinge means on said other side panel including a perforated line within a score line.

9. The carton of claim 8 further comprising a liner including at least three walls.

10. The carton of claim 9 wherein at least one wall of the liner is substantially the same height as the panel which it lines.

11. The carton of claim 9 wherein each wall of said liner has substantially the same dimensions as one of said panels of said carton prior to removal of the tear tape.

12. The carton of claim 11 wherein said liner comprises four walls each of which has substantially the same dimensions as one of said panels of said carton prior to removal of the tear tape.

13. The carton of claim 9 wherein said liner is adhesively attached to at least one of said panels.

14. The carton of claim 8 wherein said tear tape comprises two generally parallel lines of weakness in said panels.

15. The carton of claim 8 wherein said tear tape further comprises a grasping tab.

16. The carton of claim 8 further comprising a liner having at least one wall having substantially the same dimensions as one of the carton panels prior to removal of the tear tape.

17. The carton of claim 16 wherein said liner comprises at least two walls each of which has substantially the same dimensions as one of the carton panels.

18. The carton according to claim 8 wherein the second side panel has two sides and is defined by score lines on both sides and wherein the perforated line within the score line does not extend to either of said panel-defining score lines.

19. The carton according to claim 8 wherein said perforated line within a score line is in the same plane as the tear tape.

20. A carton comprising a) a first side panel, b) a front panel adjacent thereto, c) a second side panel adjacent to said front panel on the side opposite said first side panel, d) a rear panel between said first and second side panels, e) bottom closure flaps, f) top closure flaps, g) a tear tape extending at least through said front and rear panels and said first side panel, h) said second side panel being not completely traversed by said tear tape, i) said side panels being narrower than said front and rear panels, j) a liner including i) a first side wall having dimensions substantially the same as said first side panel, ii) a front wall having dimensions substantially the same as said front panel, iii) a second side wall adjacent said front wall on the side opposite said first side wall and having dimensions substantially the same as said second side panel, and iv) a rear wall having dimensions substantially the same as said rear panel, whereby said second side panel acts as a hinge when said tear tape is removed from said front and rear panels and said first side panel, further comprising hinge means on said second side panel including a perforated line within a score line.

21. The carton of claim 20 wherein said liner is adhesively attached to at least one of said panels.

22. The carton according to claim 20 wherein the second side panel has two sides and is defined by score lines on both sides and wherein the perforated line within the score line does not extend to either of said panel-defining score lines.

23. The carton according to claim 20 wherein said perforated line within a score line is in the same plane as the tear tape.

24. A carton comprising a) a first side panel, b) a front panel adjacent thereto, c) a second side panel adjacent to said front panel on the side opposite said first side panel, d) a rear panel between said first and second side panels, e) said front and rear panels being broader than said side panels, f) bottom closure flaps, g) top closure flaps, h) a tear tape extending completely through said front panel, one of said side panels and said rear panel, said tear tape not fully traversing the other of said side panels so that said other side panel serves as a hinge when said tear tape is removed, further comprising hinge means on said other side panel including a perforated line within a score line, the score line being spaced from the top and bottom closure flaps.

25. The carton of claim 24, further comprising a liner including at least three walls.

26. The carton of claim 25, wherein said liner includes i) a first side wall having dimensions substantially the same as said first side panel, ii) a front wall having dimensions substantially the same as said front panel, iii) a second side wall adjacent said front wall on the side opposite said first side wall and having dimensions substantially the same as said second side panel, and iv) a rear wall having dimensions substantially the same as said rear panel.

27. The carton according to claim 24 wherein the second side panel has two sides and is defined by score lines on both sides and wherein the perforated line within the score line does not extend to either of said panel-defining score lines.

28. The carton according to claim 24 wherein said perforated line within a score line is in the same plane as the tear tape.

* * * * *